US008151935B2

(12) United States Patent
Graham

(10) Patent No.: US 8,151,935 B2
(45) Date of Patent: Apr. 10, 2012

(54) LIFTING AND POSITIONING APPARATUS

(76) Inventor: Geoff Graham, Shepparton East (AU)

( * ) Notice: Subject to any disclaimer, the term of this patent is extended or adjusted under 35 U.S.C. 154(b) by 478 days.

(21) Appl. No.: 11/816,798

(22) PCT Filed: Feb. 21, 2006

(86) PCT No.: PCT/AU2006/000216
§ 371 (c)(1),
(2), (4) Date: Sep. 12, 2007

(87) PCT Pub. No.: WO2006/086851
PCT Pub. Date: Aug. 24, 2006

(65) Prior Publication Data

US 2008/0135334 A1 Jun. 12, 2008

(30) Foreign Application Priority Data

Feb. 21, 2005 (AU) ..... 2005900797

(51) Int. Cl.
*E06C 5/00* (2006.01)

(52) U.S. Cl. ..... 182/69.5; 182/62.5; 182/69.6

(58) Field of Classification Search ..... 182/62.5, 182/69.5, 69.6
See application file for complete search history.

(56) References Cited

U.S. PATENT DOCUMENTS

| | | | | | |
|---|---|---|---|---|---|
| 439,976 | A * | 11/1890 | Oehrl | 182/62.5 |
| 818,304 | A * | 4/1906 | Shaw | 182/62.5 |
| 822,842 | A * | 6/1906 | Holm | 182/62.5 |
| 1,127,173 | A * | 2/1915 | Boyd | 248/237 |
| 1,546,698 | A * | 7/1925 | Zoll et al. | 182/62.5 |
| 2,647,022 | A * | 7/1953 | Smid et al. | 182/13 |
| 3,509,965 | A * | 5/1970 | Mitchell | 182/62.5 |
| 3,709,322 | A * | 1/1973 | Mitchell | 182/62.5 |
| 3,966,069 | A * | 6/1976 | Fathauer | 414/607 |
| 4,130,178 | A * | 12/1978 | Smith, Jr. | 182/141 |
| 4,356,887 | A * | 11/1982 | Fisher et al. | 182/69.5 |
| 4,943,034 | A * | 7/1990 | Wagnon | 254/122 |
| 5,624,006 | A * | 4/1997 | Richardson, Jr. | 182/45 |
| 6,439,635 | B1 * | 8/2002 | Hardy et al. | 296/65.01 |
| 2003/0198550 | A1 | 10/2003 | Granroth et al. | |

FOREIGN PATENT DOCUMENTS

| | | |
|---|---|---|
| JP | 62197696 | 12/1987 |
| JP | 6-25296 | 8/1992 |
| JP | 08188394 | 7/1996 |
| JP | 11-060176 | 3/1999 |

OTHER PUBLICATIONS

Office Action of Nov. 22, 2011 (3 pages) in Japanese application No. 2007-555,426 filed Nov. 17, 2011 and English translation thereof (2 pages).

* cited by examiner

*Primary Examiner* — Alvin Chin Shue
*Assistant Examiner* — Candace L Bradford
(74) *Attorney, Agent, or Firm* — Hovey Williams LLP

(57) ABSTRACT

A lifting and positioning apparatus (10) including a base support (14), an elevator mechanism (12) having an upper and a lower end; an actuator (21) for operating the elevator mechanism between a collapsed and a raised operating position; and a positioning component (20) mounted on the upper end of the elevator mechanism providing for horizontal linear motion backwards and forwards in a first direction (X), horizontal linear motion backwards and forwards in a second direction (Y), and horizontal rotation (Z).

6 Claims, 7 Drawing Sheets

LIFTING AND POSITIONING APPARATUS

This is a national phase application in the United States of International Application CT/AU2006/000216 filed 21 Feb. 2006, claiming priority from Australian application number 2005900797 filed 21 Feb. 2005, the disclosures of which are incorporated herein by reference.

FIELD OF THE PRESENT INVENTION

The present invention relates generally to an apparatus for lifting loads. The invention relates more particularly to an apparatus for lifting and adjusting the position of a load to facilitate installation of heavy and/or bulky structures.

BACKGROUND TO THE INVENTION

Maintenance and construction of buildings and similar tall structures often involves lifting of heavy and/or bulky loads such as beams, trusses, guttering, roller doors and the like. Various apparatus is available to enable such loads to be lifted to elevated areas. Such devices include block and tackle arrangements, hoists, and scissors lift platform apparatus.

A block and tackle arrangement or similar pulley system is used to significantly reduce the force required to elevate a load. It is generally not possible however, to adjust the position of the load on the horizontal plane using such apparatus.

Scissor lift platform apparatus are typically provided on a mobile base support. The lift apparatus therefore provides for elevation of heavy and/or bulky loads in addition to limited adjustment on the horizontal plane, that is, movement of the entire apparatus at ground level. It is generally not possible, however to adjust the position of the load once it has been elevated.

Whilst apparatus such as pulley arrangements and scissor lift platforms are useful in elevating heavy loads, they are generally difficult to manoeuvre and as such do not facilitate the positioning of a heavy load where it is required. This can make installation of heavy and/or bulky structures, such as for example fitting a roller door to a bracket secured at an elevated position, difficult.

The discussion of background to the invention herein is included to explain the context of the invention. This is not to be taken as an admission that any of the material referred to was published, known or part of the common general knowledge in Australia as at the priority date of any of the claims.

SUMMARY OF THE INVENTION

According to an aspect of the present invention, there is provided a lifting and positioning apparatus including:

(a) a base support;

(b) an elevator mechanism having an upper and a lower end;

(c) an actuator for operating the elevator mechanism between a collapsed position and a raised operating position;

(d) a positioning component mounted on the upper end of the elevator mechanism providing for horizontal linear motion backwards and forwards in a first direction, horizontal linear motion backwards and forwards in a second direction, and horizontal rotation.

In a preferred form of the invention, the positioning component may include a trolley assembly which provides for horizontal linear motion backwards and forwards in the first direction.

In another preferred form of the invention, the positioning component includes a rotating platform mounted on the trolley assembly which provides for horizontal rotation.

In yet another preferred form of the invention, the positioning component includes a slide plate mounted on the rotating platform, the slide plate which provides for horizontal linear motion in the second direction.

Preferably, the first direction is substantially perpendicular to the second direction.

Preferably, the base support includes a chassis mounted on at least one axle and a wheel means rotatably mounted on either end of the axle. More preferably, the base support is configured to both support and transport the elevator mechanism and positioning component whilst also providing means for transport of ancillary materials.

More preferably, the lifting and positioning apparatus further includes at least one stabilizer means mounted on either side of the chassis to stabilize the base support whilst the elevator mechanism is in use.

The rotating platform may include a braking mechanism which clamps the rotating platform in a desired position. In an alternative embodiment, rotation of the platform is actuated by hydraulic, pneumatic or electric means.

The lifting and positioning apparatus may further include a pair of cradle brackets fitted to opposing ends of the trolley assembly. Preferably, the cradle brackets are collapsible.

According to another aspect of the present invention, there is provided lifting and positioning apparatus including:

(a) a base support including a chassis mounted on at least one axle having a wheel means rotatably mounted on either end of the axle;

(b) a scissor lift mechanism having an upper and a lower end;

(c) an actuator for operating the elevator mechanism between a retracted position and an extended position;

(c) a trolley assembly mounted on the upper end of the elevator mechanism providing for horizontal linear motion backwards and forwards in a first direction;

(d) a rotating platform mounted on the trolley assembly providing for horizontal rotation; and (e) a slide plate mounted on the rotating platform providing for horizontal linear motion backwards and forwards in a second direction.

According to yet another aspect of the present invention, there is provided a method for lifting and positioning heavy or bulky loads using a lifting and positioning apparatus including a base support; an elevator mechanism having an upper and a lower end; an actuator for operating the elevator mechanism between a collapsed position and a raised operating position; and a positioning component mounted on the upper end of the elevator mechanism, the method including the followings steps:

(a) positioning the load on the apparatus;

(b) moving the apparatus to a location substantially beneath the desired elevated position of the load;

(c) actuating the elevator mechanism until the load reaches the desired elevation; and (d) maneuvering the load using the positioning component to provide horizontal linear motion backwards and forwards in a first direction, horizontal linear motion backwards and forwards in a second direction, and horizontal rotation as required.

According to an embodiment, the method is preceded by the following steps:

(a) placing the load on the lifting and positioning apparatus; and (b) transporting the apparatus and load to a job site.

An advantage of the invention is that the lifting apparatus facilitates positioning of the heavy load or item being lifted to simplify the construction process.

BRIEF DESCRIPTION OF THE DRAWINGS

The invention will now be described in further detail by reference to the accompanying drawings. It is to be understood that the particularity of the drawings does not supersede the generality of the preceding description of the invention.

DETAILED DESCRIPTION

Figure 1:
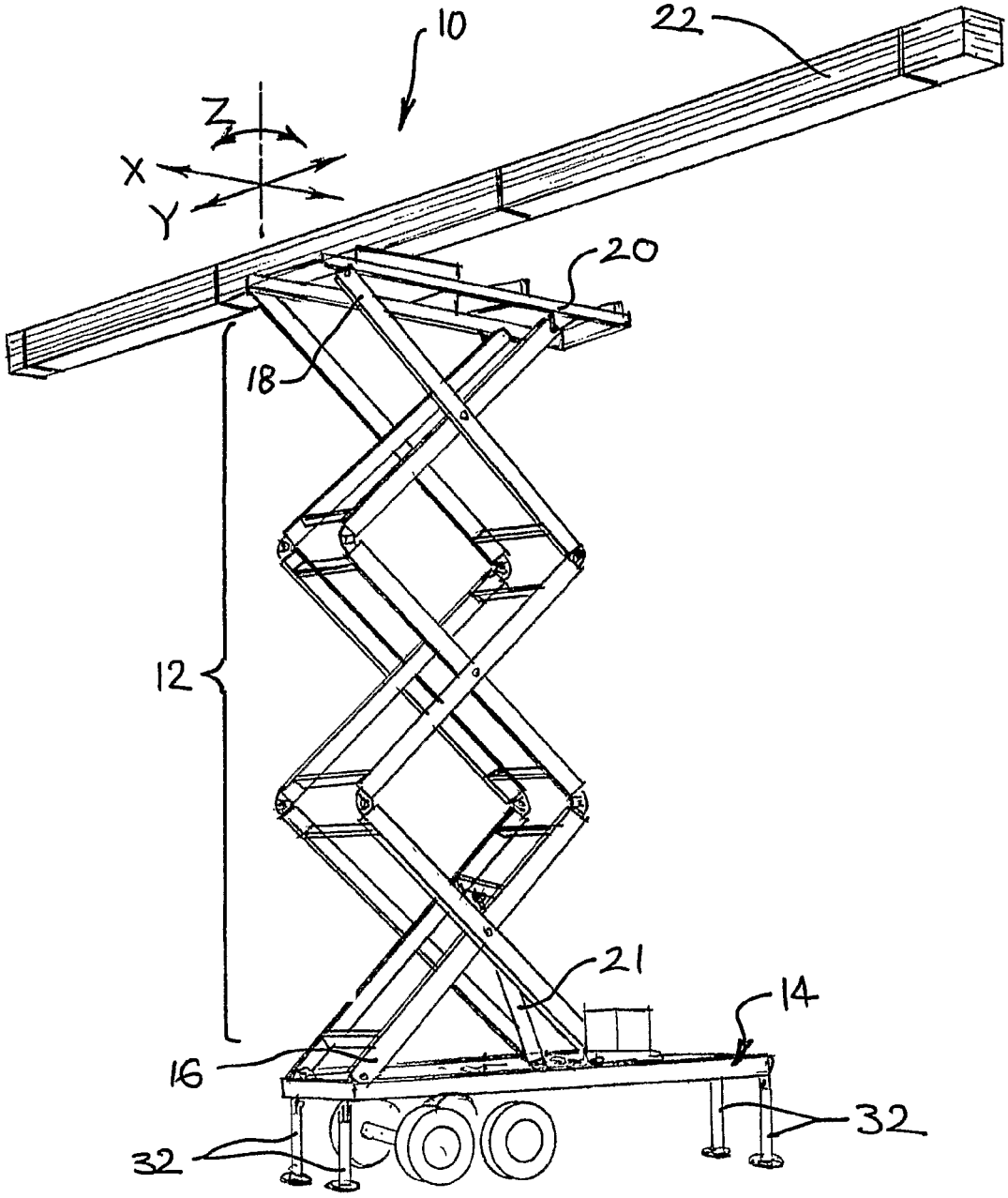
FIG. 1 is a simplified drawing of the lifting and positioning apparatus according to an embodiment of the present invention with the elevator mechanism in a raised operating position.

Referring firstly to FIG. 1, the invention provides a lifting and positioning apparatus 10 including an elevator mechanism 12 carried on a base support 14. A lower end 16 of the elevator mechanism 12 rests on the base support 14 and an upper end 18 of the elevator mechanism 12 supports a positioning component 20.

Figure 3:
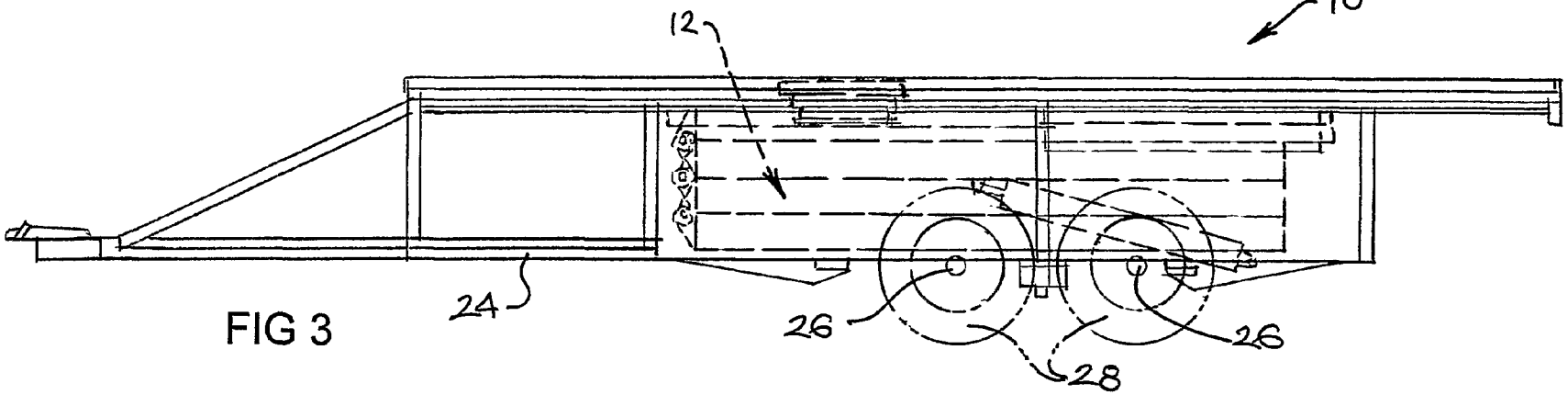
FIG. 3 is a side view of the lifting and positioning apparatus mounted on a base support according to another embodiment of the invention with the elevator mechanism in a collapsed position.
Figure 4B:
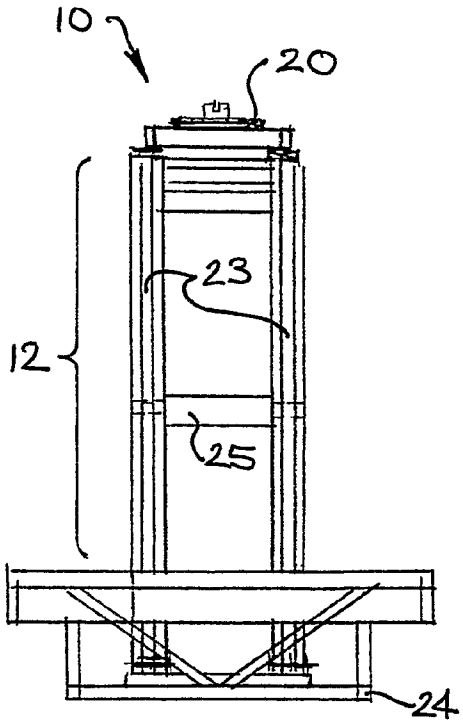
FIG. 4B is a rear view of the lifting and positioning apparatus of FIG. 4A.
Figure 4A:
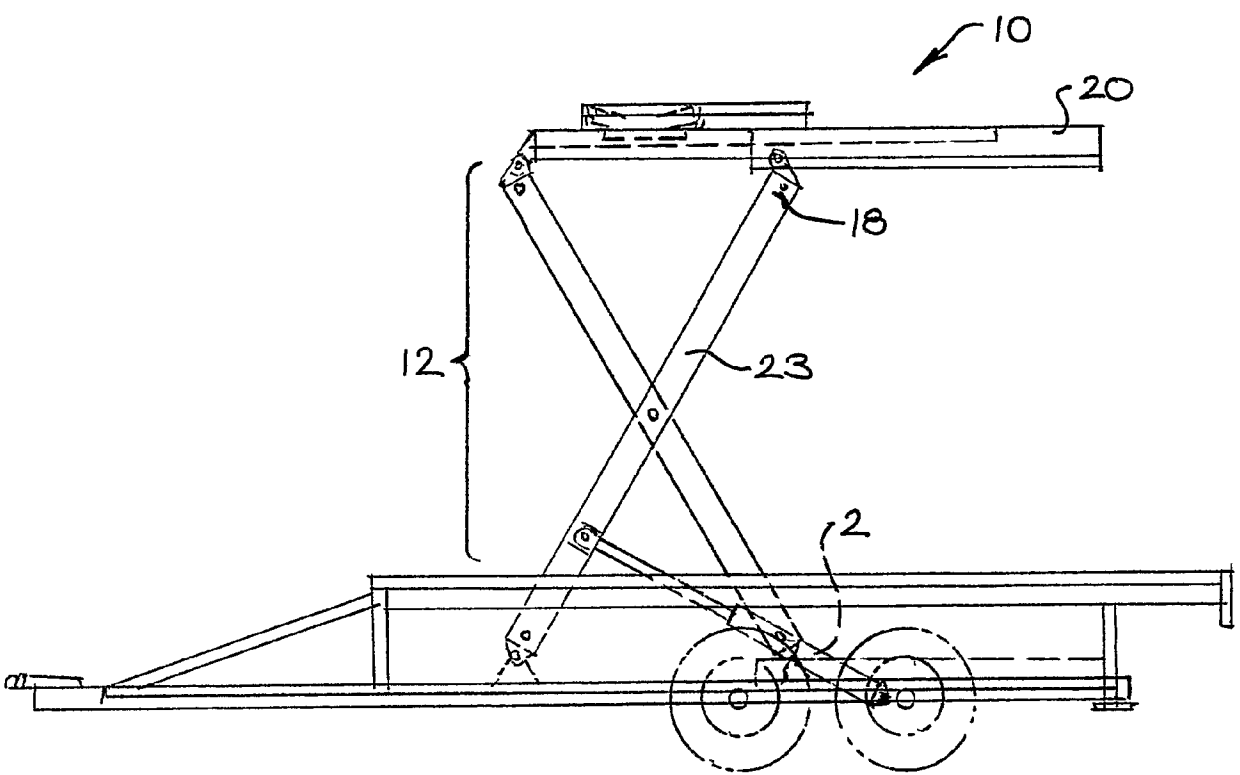
FIG. 4A is a side view of the lifting and positioning apparatus of FIG. 2A with the elevator mechanism in a raised position.
Figures 5A, 5B:
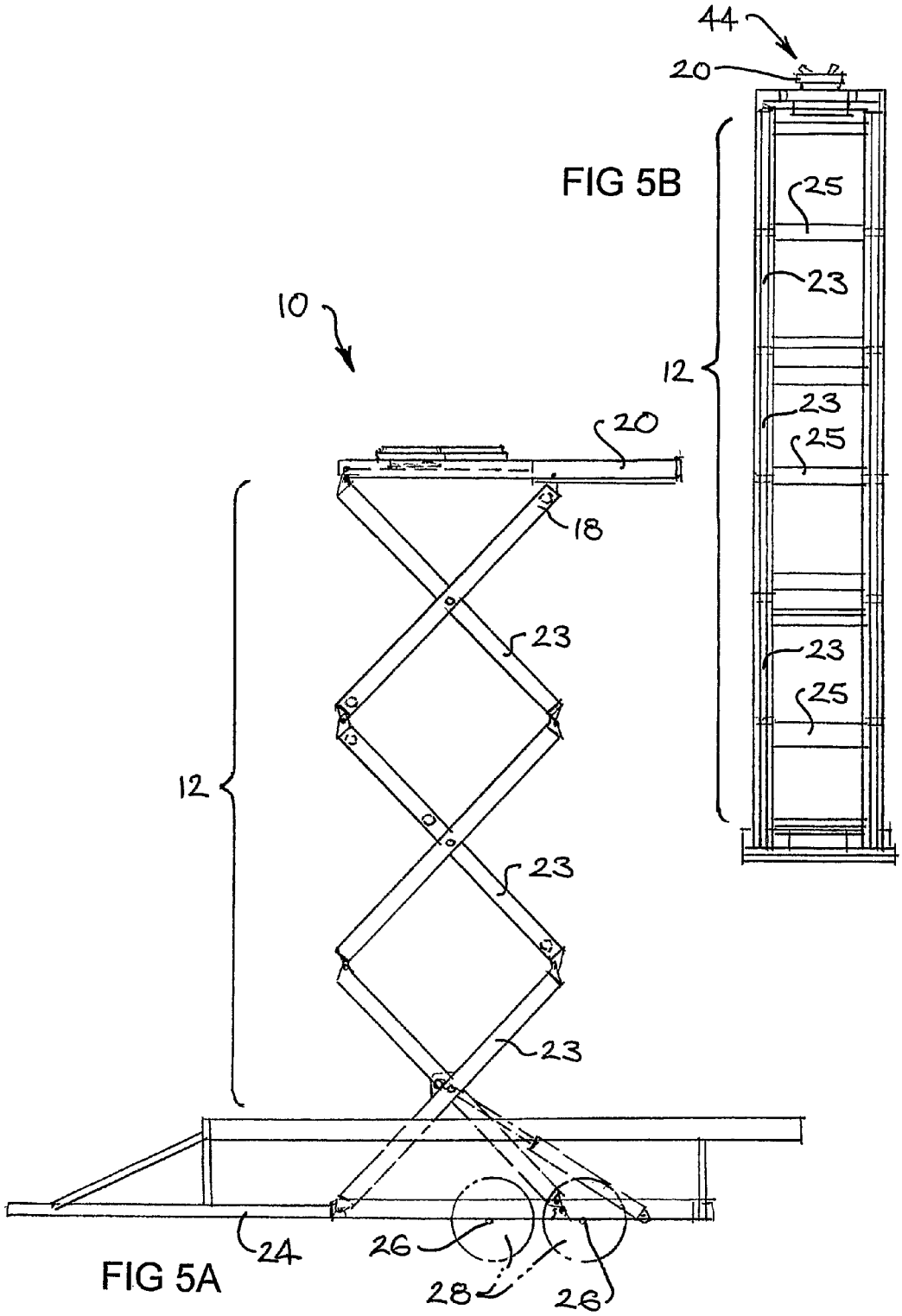
FIG. 5A is a side view of the lifting and positioning apparatus of FIG. 3 with the elevator mechanism in a raised position.
FIG. 5B is a rear view of the lifting and positioning apparatus of FIG. 5A.

An actuator 21 operates the elevator mechanism 12 between a collapsed position (see FIGS. 2A and 3) and a raised operating position (see FIGS. 1, 4A and 5A). In the operating position, the positioning component 20 may be actuated to provide horizontal linear motion backwards and forwards in a first direction X, horizontal linear motion backwards and forwards in a second direction Y, and horizontal rotation Z. In combination these movements facilitate maneuvering of a heavy load 22 such as a roller door when the elevator means 12 is in the operating position.

Figure 2A:
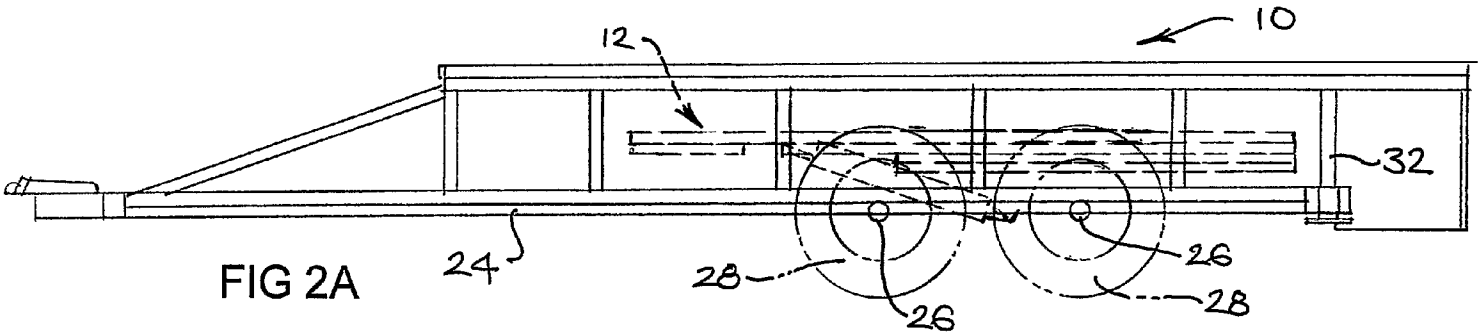
FIG. 2A is a side view of the lifting and positioning apparatus mounted on a base support according to an embodiment of the invention with the elevator mechanism in a collapsed position.
Figure 2B:
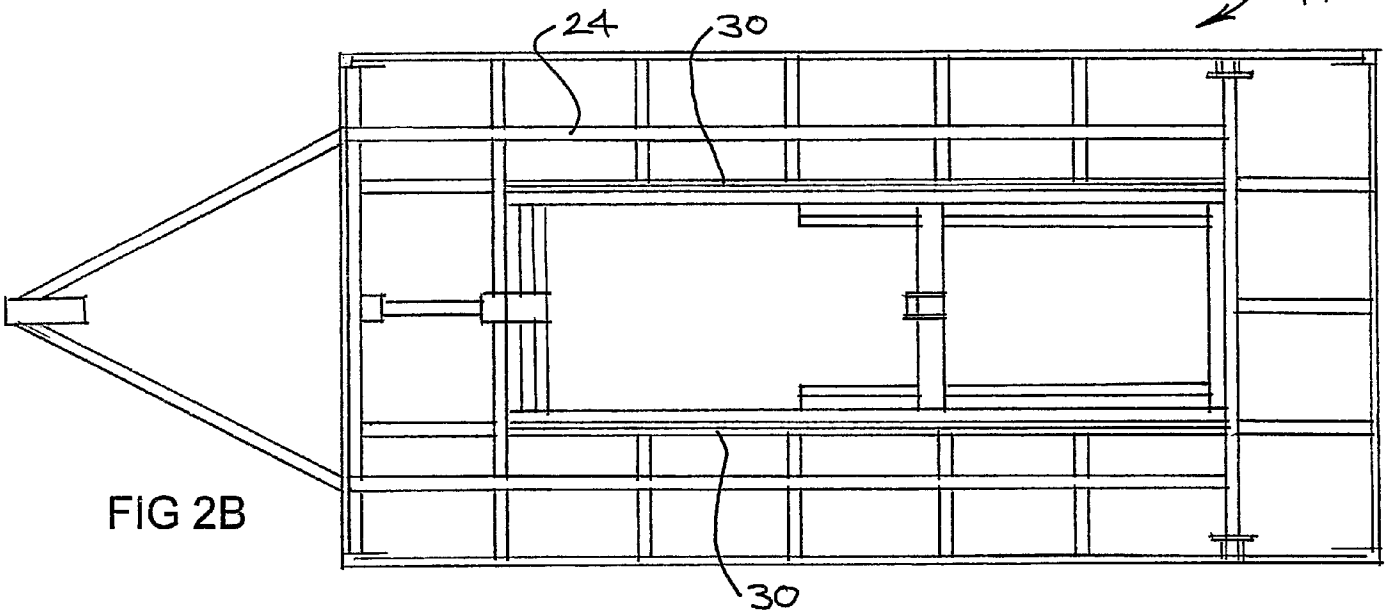
FIG. 2B is a simplified overhead view of the lifting and positioning apparatus of FIG. 2A.

Referring now to FIGS. 2A and 2B, the base support 14 includes a chassis 24 mounted on two axles 26 with wheel means 28 rotatably mounted on either end of the axles 26. As shown in FIGS. 2A and 2B, the base support 14 is provided in the form of a mobile trailer in accordance with an embodiment of the invention. Although it is not essential to the working of the invention that the base support 14 be mobile, it will be evident that it is advantageous if the base support 14 is configured such as to act both as a support for the elevator mechanism 12 and as a transport means for the lifting and positioning apparatus 10.

The base support 14 is configured to house the elevator mechanism 12. This configuration includes two parallel support members 30 between which the elevator mechanism 12 is retained. Whilst it is envisaged that the chassis 24 could be mounted on any number of axles 26, improved stability is achieved with a minimum of two axles 26.

The base support 14 preferably also includes at least one stabilizer means 32 mounted on either side of the chassis and preferably one positioned in each corner of the base support 14 (as shown in FIG. 1), to stabilize the base support 14 whilst the elevator mechanism 12 is in use. The stabilizer means 32 may take the form of extendable hydraulic jacks.

In FIGS. 2A and 3, the elevator mechanism 12 is shown in the collapsed position. The elevator mechanism 12 most preferably consists of a scissor lift mechanism as illustrated in the Figures. Such scissor lift mechanisms 12 consist of pivotally connected pairs of beams. Application of a force by an actuator 21 (see FIG. 1) to at least one pair of crossed beams (usually the first pair of beams at the lower end of the elevator assembly) transmits the actuating force to the entire structure and causes the crossed beams to open and close and thereby raise and lower the structure. The actuator 21 means usually takes the form of one or more hydraulic cylinders which extend and retract to elevate the platform from the collapsed to the raised operating position. The advantage of using a scissor lift mechanism to perform the elevation is that the bulk of the elevator mechanism can be collapsed for transport between work sites.

FIG. 2A shows a lifting and position apparatus with a collapsed elevator mechanism 12 having a single stage scissor lift apparatus. Conversely, FIG. 3 shows a lifting and positioning apparatus with a collapsed elevator mechanism 12 having a three stage scissor lift apparatus. In both FIGS. 2A and 3 the elevator mechanism 12 is in the collapsed position. These different types of scissor lift mechanism will become more apparent in the raised operating position shown in FIGS. 4A and 5A. It should be understood that the elevator mechanisms 12 shown in the Figures illustrate example embodiments of the invention only and that 2, 4, 5, etc, stage scissor lift apparatus can be provided as required.

Referring now to FIG. 4A, the lifting and position apparatus of FIG. 2A is shown in the raised operating position. The elevator mechanism 12 includes of a two pairs of pivotally connected beams 23 to form a single stage scissor lift apparatus. FIG. 4B is a rear view of the lifting and positioning apparatus of FIG. 4A showing the connection between pairs of beams 23 via a cross linkage member 25 forming a hinge.

Similarly, FIG. 5A shows the lifting and positioning apparatus of FIG. 3 in the raised operating position. The three stage scissor lift apparatus includes six pairs of pivotally connected beams 23. FIG. 5B shows the lifting and position apparatus of FIG. 5A from the rear and illustrates the pivotal connection between pair of beams 23 via the cross linkage members 25.

Figure 6A:
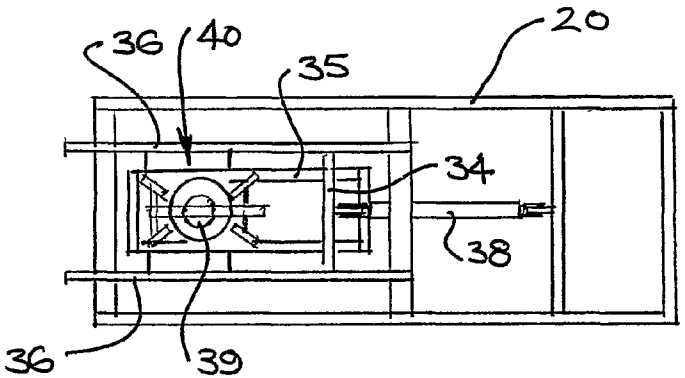
FIG. 6A is an overhead view of the positioning component according to an embodiment of the invention.

Referring now to FIG. 6A, the positioning component 20 is supported by the upper end 18 of the elevator mechanism 12. The positioning component 20 includes a trolley assembly 34 which provides for horizontal linear motion backwards and forwards in the first direction X.

The trolley assembly 34 is retained by two parallel support members 36 mounted on the upper end 18 of the scissor lift mechanism 12. Movement of the trolley assembly 34 is provided by a hydraulic ram 38 or equivalent actuating means. In one particular embodiment, the range of movement in the first direction X is around 400 millimetres.

A pair of cradle brackets 44 (see FIG. 5B) are preferably fitted to each opposing end of the trolley assembly 34 to support the load during elevation and positioning. Preferably, the cradle brackets are collapsible such that the cradle bracket can be collapsed to the "down" position to enable a roller door or other structure to be rolled or slid across the bracket and then moved into the "up" position to secure the roller door in place.

Figure 6C:
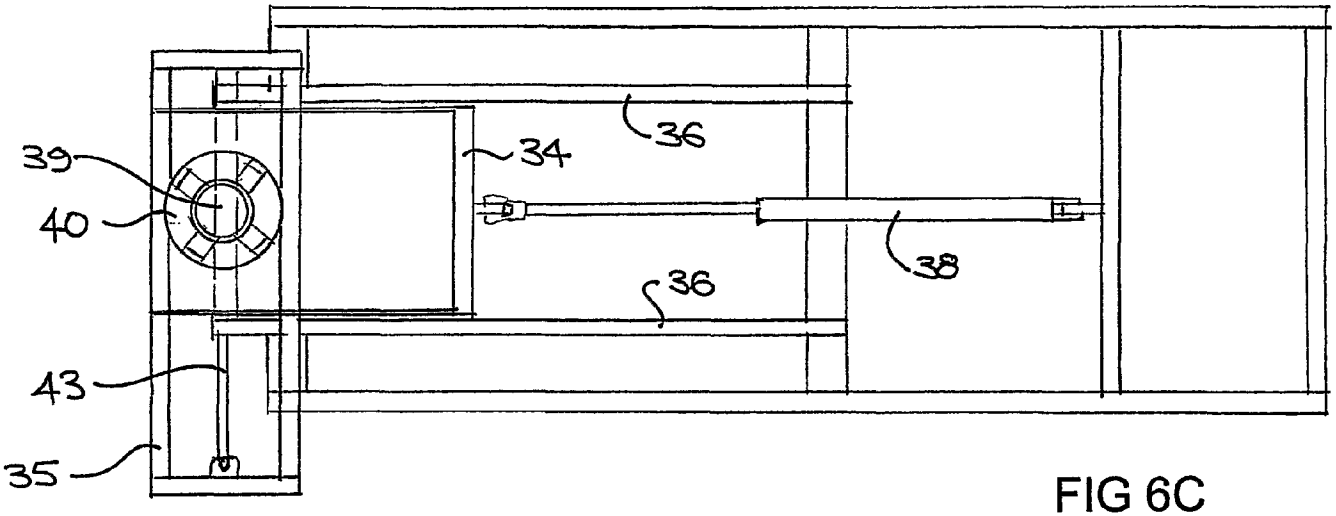
FIG. 6C is an overhead view of the positioning component of FIG. 6A shown with the positioning component rotated in the Z direction.
Figure 6B:
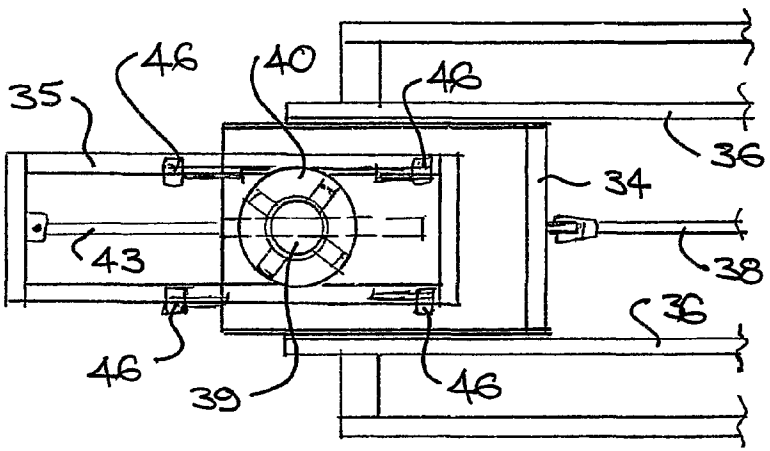
FIG. 6B is an overhead view of the positioning component of FIG. 6A shown with the positioning component moved along the X direction.

FIG. 6A shows the positioning component in the resting position, that is, with the hydraulic ram 38 contracted. In FIG. 6B, the hydraulic ram 38 has been extended, thereby moving the positioning component forward in the X direction. The trolley assembly 34 includes wheel means 46 to facilitate movement in the first direction X. In FIG. 6C, the positioning component has been moved forward in the X direction, and also rotated 90 degrees in the Z direction. This sequence of Figures shows a sample of the range of movement that is achievable using the positioning component.

Figure 7A:
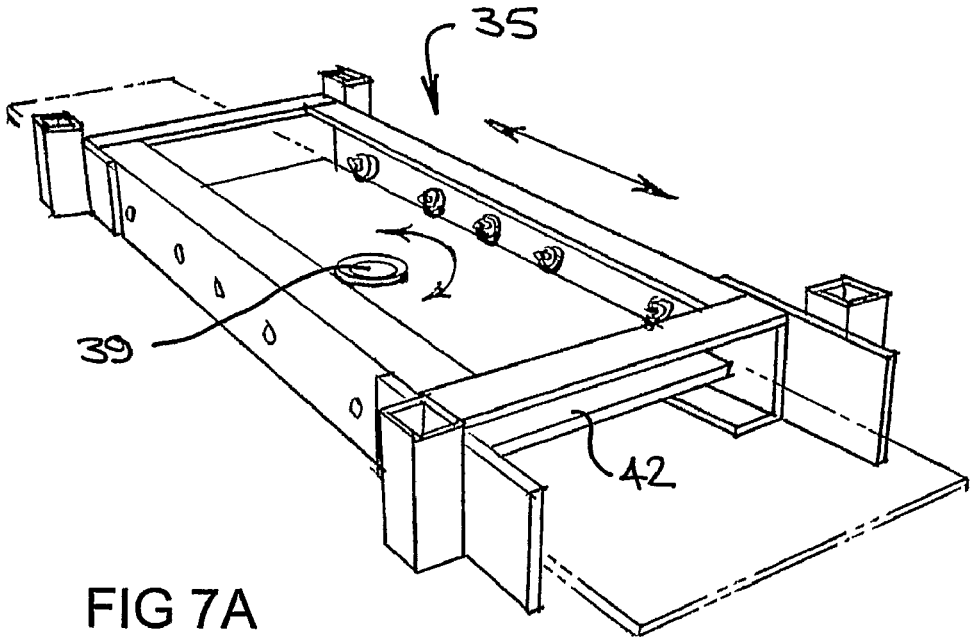
FIG. 7A is a perspective view of the internal cradle assembly as viewed from above.
Figure 7B:
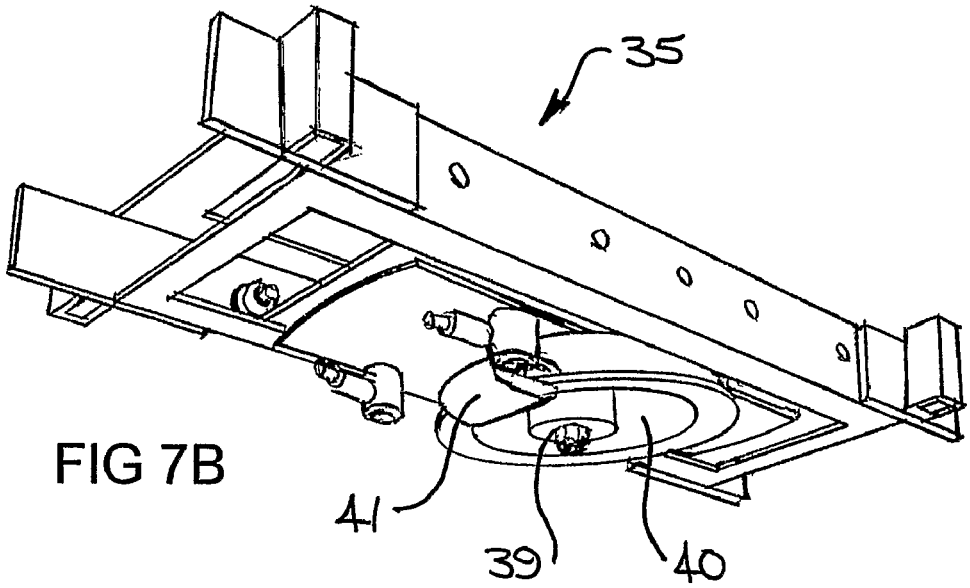
FIG. 7B is a perspective view of the internal cradle assembly of FIG. 7A as viewed from underneath.

Referring now to FIGS. 7A and 7B, the trolley assembly 34 has an internal cradle assembly 35 which houses an axle 39. Mounted on the axle is a rotating platform 40. A slide plate 42 is mounted on the rotating platform 40 and provides for horizontal linear motion in the second direction Y. The rotating platform 40 facilitates horizontal rotation Z of the slide plate 42 to around 110 degrees to either side of centre C.

Movement of the slide plate 42 is actuated by a hydraulic ram 43 or equivalent actuating means. In one particular embodiment, the range of movement in the second direction Y is around 200 millimetres. The rotating platform 40 preferably includes a braking mechanism 41 to clamp the rotating platform 40 when the load 22 has been maneuvered to a desired position. In this case, the rotating platform may be operated by hand. Alternatively, rotation of the platform may be hydraulically, pneumatically or electrically actuated such that no clamping or braking mechanism is required. In this case, rotation will cease when the actuating force is no longer applied to cause rotation of the platform.

FIG. 8 shows how the trolley assembly and internal cradle assembly are mounted on the elevator mechanism 12. In the illustrated view, the internal cradle assembly 35 and slide plate 42 has been rotated to facilitate movement on the second direction Y.

According to a preferred embodiment, the base support is provided in the form of a mobile trailer such that lifting and positioning apparatus is readily transportable whilst also providing means for transporting the materials required to complete a particular job. The apparatus is designed to minimise the handling of tools, e.g. the elevator mechanism and positioning component, and the materials, e.g. roller doors, shutters or other structural elements, from the time when the materials are collected from the supplier, to the time when they are installed at the job site.

The trailer itself is constructed to support and transport a maximum length roller door or shutter. In one embodiment, this may be achieved by providing an extendible drawbar to the trailer to enable the overall length of the trailer to be adjusted to accommodate materials of longer length whilst still allowing the trailer to be constructed in a length that is convenient for storage and carrying smaller loads. This avoids the overhang of materials over the rear of the trailer during transportation of materials to a job site.

Using the lifting and positioning apparatus of the present invention, the materials required for a particular job can be loaded directly onto the lifting and positioning apparatus by the supplier prior to transportation to the installation job site to avoid double handling of the materials. The supplier simply loads the roller door or other materials onto the trailer using a crane or fork lift. Once the roller door is positioned in place, the cradle brackets are fixed in the "up" position to secure the roller door in place during transportation and elevation. The entire apparatus is then transported to the job site by towing the apparatus using a suitable towing vehicle.

Once at the job site, the brackets for mounting the roller door are fitted to the structure. Once the brackets are in place, the lifting and positioning apparatus is moved to a position roughly directly beneath where the roller door is to be installed. Once the apparatus is positioned, the load is elevated by actuating the elevator mechanism until the desired height is reached. The load is then maneuvered using a positioning component mounted on the upper end of the elevator mechanism to provide horizontal linear motion backwards and forwards in a first direction, horizontal linear motion backwards and forwards in a second direction, and horizontal rotation. This enables the load to be precisely positioned for mounting on the brackets.

It is an advantage that heavy and bulky loads are able to be precisely positioned using the apparatus of the present invention. Use of the apparatus of the present invention significantly improves the precision achievable using prior art means such as block and tackle arrangements, cranes and fork lifts. Moreover the lifting and positioning apparatus avoids the need to double handle materials and equipment. Accordingly, it is a further advantage of the present invention that occupational health and safety objectives are met by minimising the need for workmen to handle heavy and bulky materials.

The lifting and positioning apparatus of the present invention has been configured particularly for use in the installation of garage and roller doors. However, it is to be understood that the apparatus may have a number of other uses such as for example use generally in construction of buildings and other structures which involve hoisting and positioning of heavy or bulky loads.

It is to be understood that various additions, alterations and/or modifications may be made to the parts previously described without departing from the ambit of the invention.

The claims defining the invention are as follows:

1. Lifting and positioning apparatus including:

(a) a base support including a chassis mounted on at least one axle having a wheel means rotatably mounted on either end of the axle;

(b) an elevator mechanism having an upper and a lower end;

(c) an actuator operatively connected to the elevator mechanism for enabling shifting of the elevator mechanism between a retracted position and an extended position;

(d) a trolley assembly mounted on the upper end of the elevator mechanism adapted for enabling substantially linear motion of the trolley assembly relative to the upper end of the elevator assembly backwards or forwards in a first direction;

(e) a rotating platform mounted on the trolley assembly adapted for rotation of the rotating platform relative to the trolley assembly in a substantially horizontal plane; and (f) a slide plate mounted on the rotating platform adapted for horizontal linear motion of the rotating platform relative to the trolley assembly backwards or forwards in a second direction;

wherein an axis of rotation of the rotating platform is displaced by moving the trolley assembly backwards or forwards in the first direction to allow for simultaneous horizontal displacement in the first and second directions; and wherein the first direction is substantially perpendicular to the second direction.

2. Lifting and positioning apparatus according to claim 1, wherein the base support is configured to support and transport the elevator mechanism and positioning component whilst also providing means for transport of ancillary materials.

3. Lifting and positioning apparatus according to claim 1, further including a pair of cradle brackets fitted to opposing ends of the trolley assembly.

4. Lifting and positioning apparatus according to claim 3, wherein the cradle brackets are collapsible.

5. A method for lifting and positioning heavy or bulky loads using a lifting and positioning apparatus including a base support, an elevator mechanism having an upper and a lower end, an actuator for operating the elevator mechanism between a collapsed position and a raised operating position, and a positioning component including a trolley assembly mounted on the upper end of the elevator mechanism, a rotating platform mounted on the trolley assembly and a slide plate mounted on the rotating platform, the method including the following steps:

(a) positioning the load on the apparatus;

(b) moving the apparatus to a location substantially beneath the desired elevated position of the load;

(c) actuating the elevator mechanism until the load reaches the desired elevation; and (d) maneuvering the load using the positioning component to displace the rotating platform to provide substantially horizontal substantially linear motion backwards or forwards in a first direction and substantially horizontal substantially linear motion backwards or forwards in a second direction;

wherein an axis of rotation of the rotating platform is displaced by moving the trolley assembly backwards or forwards in the first direction to allow for simultaneous horizontal displacement of the axis of rotation of the rotating platform in the first and second directions; and wherein the first direction is substantially perpendicular to the second direction.

6. A method according to claim 5, preceded by the following steps:

(a) placing the load on the lifting and positioning apparatus; and (b) transporting the apparatus and load to a job site.

* * * * *